US005664834A

United States Patent [19]

Hsu

[11] Patent Number: 5,664,834

[45] Date of Patent: Sep. 9, 1997

[54] ADJUSTING DEVICE OF A CHAIR

[76] Inventor: Hsiu-lan Hsu, No. 34, Alley 251, Fushang Lane, Hsitun Dist., Taichung, Taiwan

[21] Appl. No.: 727,051

[22] Filed: Oct. 8, 1996

[51] Int. Cl.[6] ..... A47C 3/00

[52] U.S. Cl. ..... 297/300.1; 297/300.5; 297/300.8; 297/301.1

[58] Field of Search ..... 297/300.1, 300.2, 297/300.5, 300.6, 300.8, 301.1, 301.4

[56] References Cited

U.S. PATENT DOCUMENTS

| | | | |
|---|---|---|---|
| 3,356,414 | 12/1967 | Doerner | 297/300.5 |
| 5,066,069 | 11/1991 | DeGelder | 297/300.8 |
| 5,228,748 | 7/1993 | Neumuller | 297/300.1 |
| 5,356,200 | 10/1994 | Stumpf et al. | 297/301.1 |
| 5,423,594 | 6/1995 | Hancock et al. | 297/300.2 |
| 5,423,595 | 6/1995 | Hancock | 297/301.1 |

*Primary Examiner*—Peter M. Cuomo
*Assistant Examiner*—Anthony D. Barfield
*Attorney, Agent, or Firm*—Kirkpatrick & Lockhart LLP

[57] ABSTRACT

An adjusting device of a chair includes a base frame in which an inner frame has one end thereof pivotally connected to a front end of the base frame by a first pin and the other end of the inner frame is connected to a sound pin which extends through two first slots defined in two side walls of the base frame. A bracket is pivotally mounted to a rear end of the base frame by a third pin and a fourth pin extending through two second slots respectively defined in the side walls and fixedly connected within the bracket. An urging element is connected between a top plate of the base frame and a fifth pin which is transversely connected within the bracket via two fourth slots defined in the two side walls. A transmitting device is connected between the fourth pin and the second pin which is slidably connected between two first slots respectively defined in the two side walls. The transmitting device has a third slot defined therein for a quick release device extending therethrough such that when pulling a back portion disposed to the bracket, a seat portion disposed on the base frame can be pivoted about the first pin simultaneously.

2 Claims, 4 Drawing Sheets

ADJUSTING DEVICE OF A CHAIR

BACKGROUND OF THE INVENTION

1. Field of the Invention

The present invention relates to an adjusting device and more particularly, to an improved adjusting device disposed in a chair such that a seat portion and a back portion can be adjusted simultaneously.

2. Brief Description of the Prior Art

A conventional office chair is partially shown in FIG. 1, the chair includes a seat portion disposed on a base frame 90 and a back portion disposed to a post 922 which is slidably received in a bracket 92 which is pivotally engaged to a rear end of the base frame 90 by a first pin 906. The base frame 90 is pivotally engaged to a chair support 912 which has an extending plate 91 extending radially therefrom for a spring 904 disposed between the extending plate 91 and an under surface of the base frame 90 so as to provide a satisfactory feature. A first moving means 94 has one end thereof pivotally connected to the bracket 92 by a second pin 928 and the other end of the first moving means 94 has a first/slot 942, a second moving means 93 having one end thereof pivotally connected to a lug 916 extending from the extending plate 91 and the other end of the second moving means 93 having a second slot 932. A control bar 96 extends through the first slot 942 and the second slot 932, the control bar 96 can fixedly position the first moving means 94 and the second moving means 93 by a rotation action, i.e. the control bar 96 performs as a quick release to control the first moving means 94 and the second moving means 93. Each of the first moving means 94 and the second moving means 93 includes of plurality of plates and each of the plates of the two moving means 94, 93 are alternately overlapped with each other at the respective two ends having the first slot 942 and the second slot 932. An urging element 908 is mounted to the first pin 906 and has two legs respectively contacting against the under surface the base frame 90 and the second pin 928. When operating the control bar 96, the first moving means 94 and the second moving means 93 move freely along the first slot 942 and the second slot 932 respectively so as to adjust the seat portion 902 and the back portion 924. After the desired positions of the seat portion 902 and the back portion 924 have been set, the control bar 96 is re-operated to fixedly position the first moving means 94 and the second moving means 93.

However, when pushing the back portion 924, the seat portion 902 is maintained still unless a force is exerted downwardly to the seat portion 902. Generally, a user adjusts the chair when he/she sits in the chair and, according to the above mentioned description, when the user exerts a force to the back portion 924 the seat portion 902 is maintained still, this puts the user in an unsatisfactory pose and his/her clothing will be pulled upwardly. Therefore, in order to adjust the seat to a desired status, the user has to use two different forces, one is exerted to the back portion 924 from the back of the user and the other force is exerted to the seat portion 902 from the posterior of the user. It is difficult for the user to exert the two forces separately when sitting on the chair.

The present invention intends to provide an improved adjusting device which can adjust the seat portion and the back portion to a desired position simultaneously so as to mitigate and/or obviate the above-mentioned problems.

SUMMARY OF THE INVENTION

The present invention provides an adjusting device of a chair, which comprises a base frame having two side walls extending from a front end thereof, each of the side walls having a first slot and a second slot defined therein, a top plate connected across the two side walls and an open rear end. A fourth slot is defined in each of the side walls and is located above the second slot corresponding thereto. An inner frame received between the two side walls has a front end thereof pivotally received between the two side walls by a first pin and a rear end of the inner frame fixedly connected to a second pin which extends through the two first slots of the base frame.

A bracket has two lateral plates pivotally mounted to the two side walls by a third pin extending through the two side walls and the two lateral plates, a fourth pin extending through the two second slots and the two lateral plates. A fifth pin extends through the two fourth slots and is connected between the two lateral plates. One end of an urging element is connected to the fifth pin and the other end of the urging element is connected to an under side of the top plate of the base frame.

A transmitting means is connected between the second pin and the fourth pin, and comprises a plurality of long plates each having a third slot defined therein for a quick release means extending therethrough which is slidably received in the first holes. The quick release means comprises a rod extending through the third slots and an operating handle is connected to the rod and extends laterally from one of the side walls so that the long plates are released by operating the operating handle. A back portion is connected to the bracket and can be pulled by the fourth pin sliding along the second slots and thus pushing the transmitting means to force the second pin to slide along the first slot such that the base frame is rotated about the first pin accordingly.

It is an object of the present invention to provide an adjusting device of a chair and which has a simple structure.

It is another object of the present invention to provide an adjusting device of a chair which allows a user to adjust the back portion and the seat portion simultaneously.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
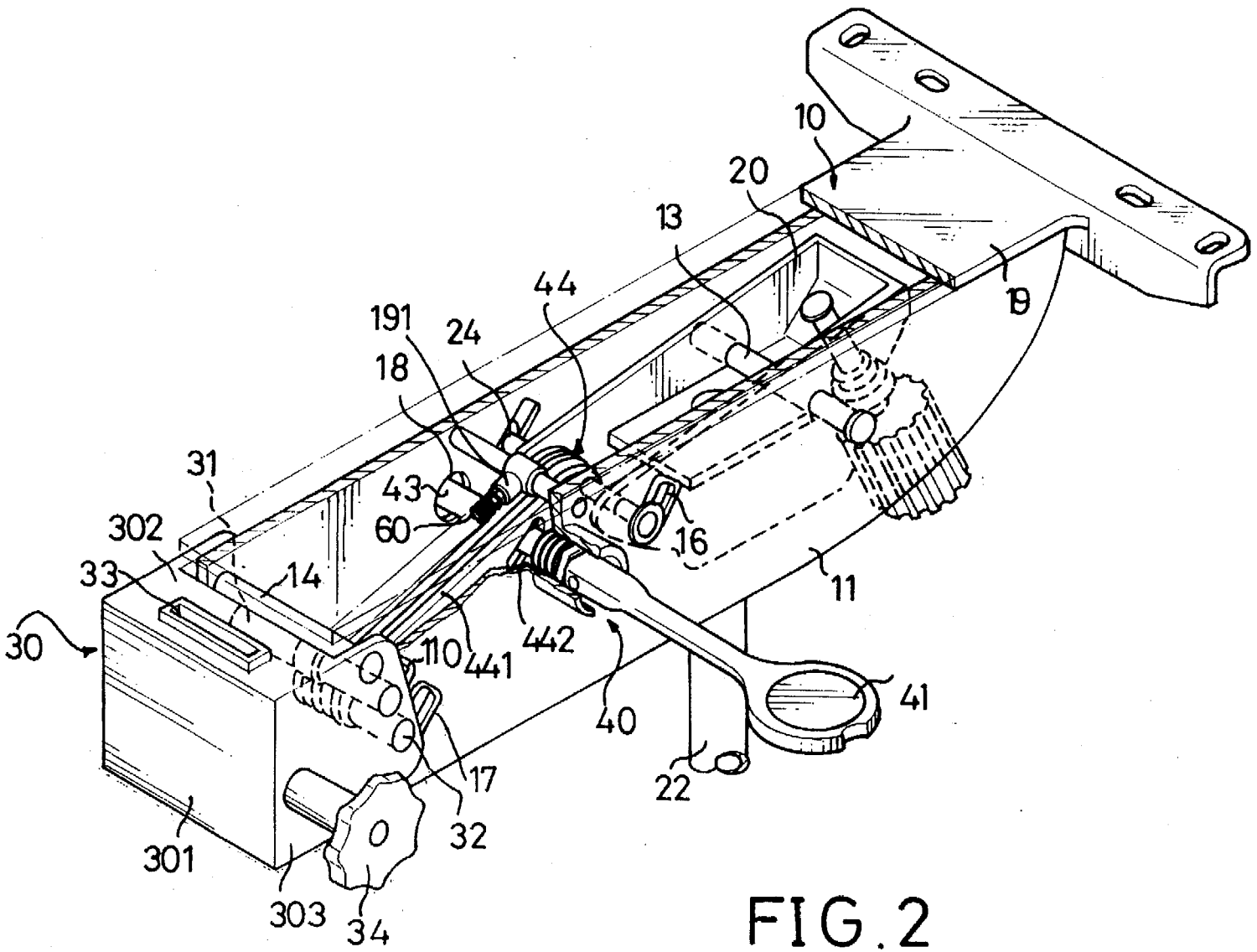
FIG. 2 is a perspective view of an adjusting device in accordance with the present invention.
Figure 3:
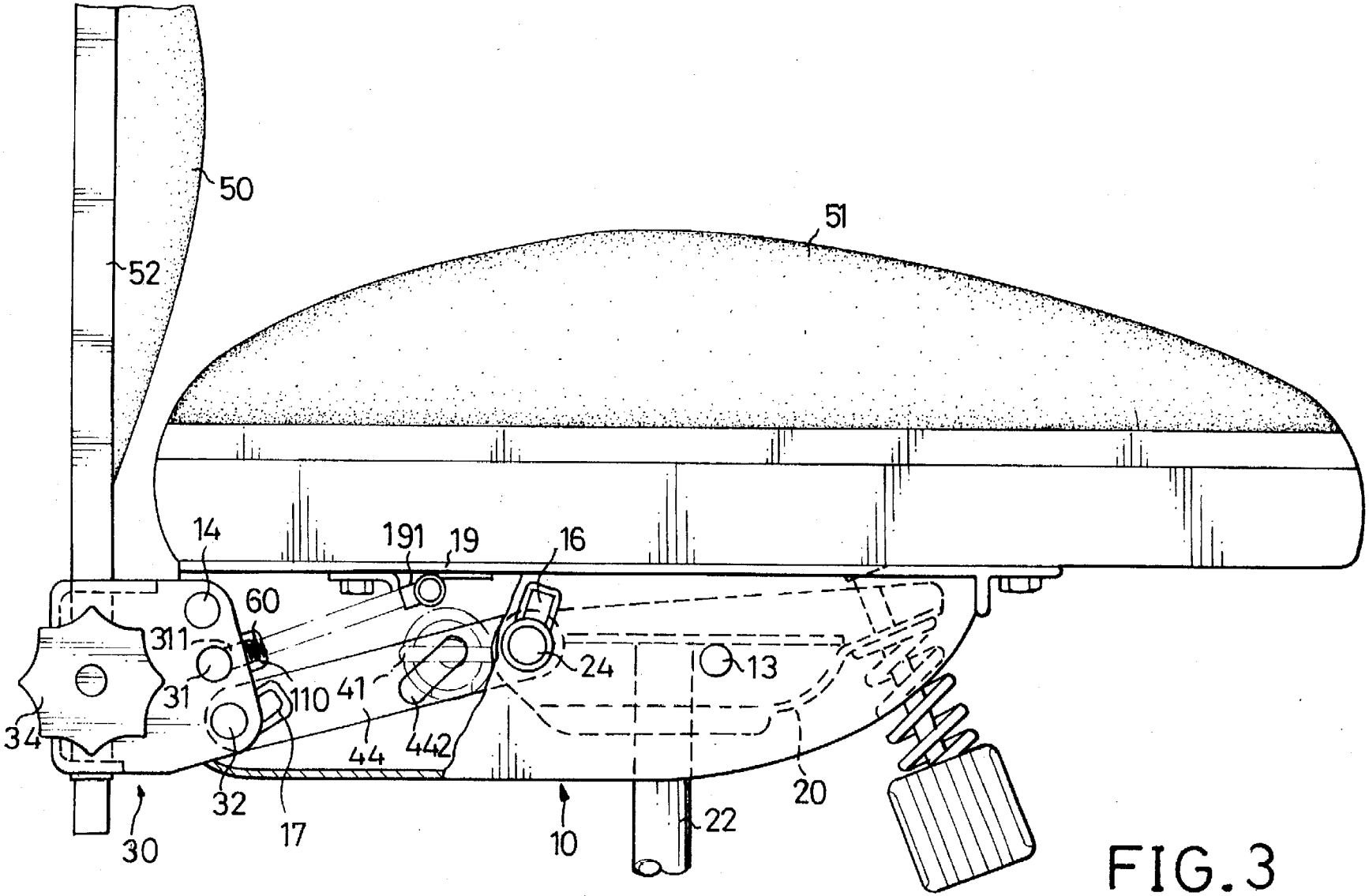
FIG. 3 is a side elevational view of the adjusting device in accordance with the present invention.
Figure 4:
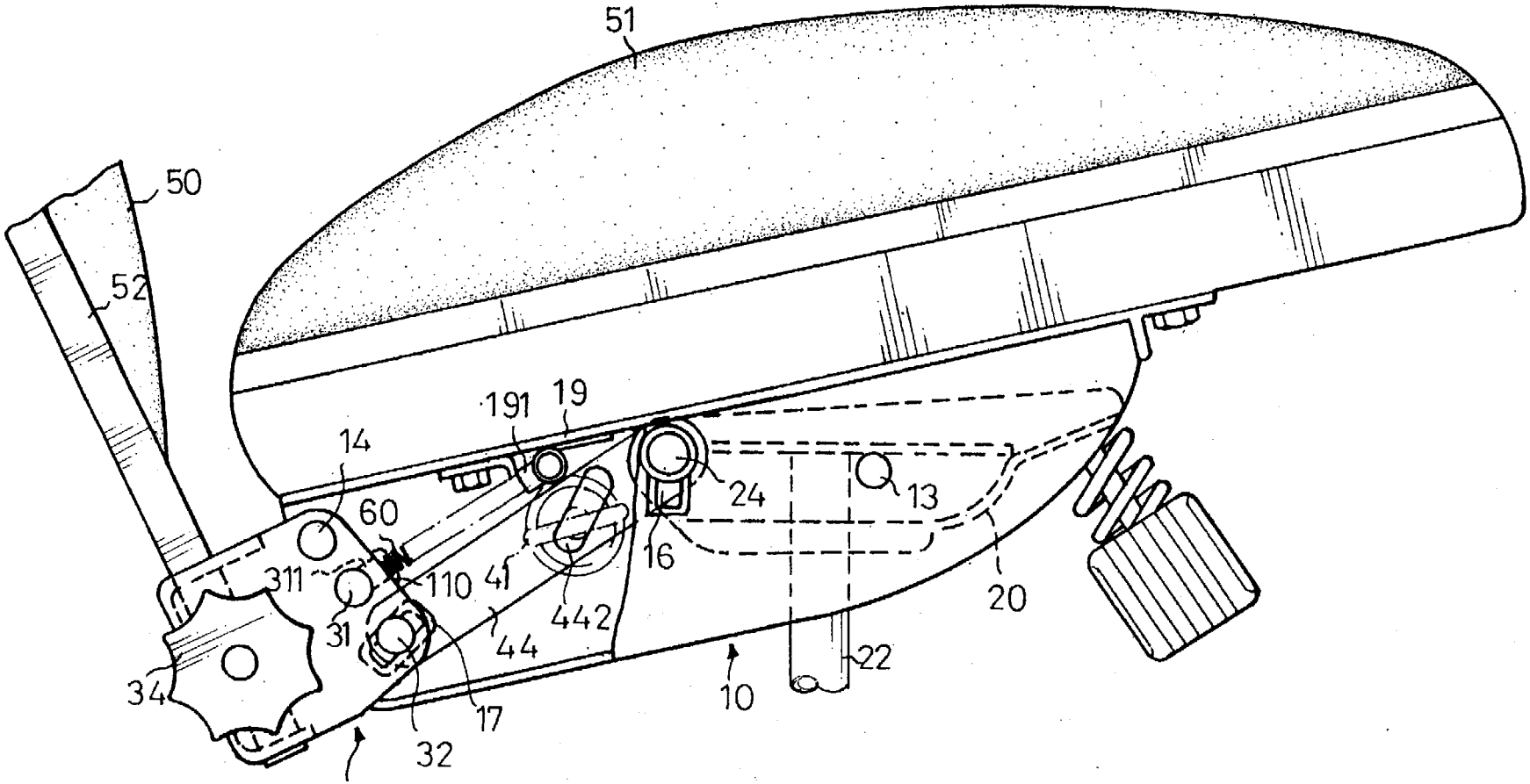
FIG. 4 is an illustrative view to show a status when the back portion is pulled rearwardly.

Referring to the drawings and initially to FIGS. 2 and 3, an adjusting device in accordance with the present invention generally includes a base frame 10 having two side wall 11 extending from a front end thereof, a top plate 19 connected across the two side walls 11 and an open rear end. A seat portion 51 is fixedly connected to an upper surface of the top plate 19. Each of the side walls 11 has a first slot 16 inclinedly defined in a middle portion thereof and a second slot 17 inclinedly defined in a rear end thereof. A fourth slot 110 is inclinedly defined in each of the side walls 11 and is located above the second slot 17 corresponding thereto. A first hole 18 is defined in each of the side walls 11 and is located between the first slots 16 and the second slots 17.

An inner frame 20 has a front end thereof pivotally received between the two side walls 11 by a first pin 13 extending through the side walls 11 and the inner frame 20, and a rear end of the inner frame 20 is fixedly connected to a second pin 24 which extends through the inner frame 20 and is slidably received within the two first slots 16 of the base frame 10. The inner frame 20 connects to a chair stand 22 (partly shown).

A bracket 30 has an end board 301, two lateral plates 303 respectively extending from the end board 301 and a top portion 302 connected between the two lateral plates 303. The top portion 302 has an oblong hole 33 defined therein for a post 52 received therein which is positioned by a screw element 34 and has a back portion 50 (FIG. 3) connected thereto. The two side walls 11 are pivotally received between the two lateral plates 303 by a third pin 14 extending therethrough. A fourth pin 32 extends through the two second slots 17 and is fixedly connected between the two lateral plates 303.

A fifth pin 31 is connected between the two lateral plates 303 via the two fourth slots 110 in the two side walls 11 and has a first tube 311 extending perpendicularly therefrom to receive a first end of an urging element 60 therein. The top plate 19 has a second tube 191 disposed to an under side thereof and the second tube 191 extends downwardly and inclinedly from the under side of the top plate 19. A second end of the urging element 60 is received in the second tube 191.

A transmitting means 44 comprising a plurality of long plates 441 is connected between the second pin 24 and the fourth pin 32, each of the long plates 441 having a third slot 442 defined therein for a quick release means 40 extending therethrough which further extends through the first holes 18. The quick release means 40 comprises a rod 43 extending through the third slots 442 and an operating handle 41 is connected to the rod 43, the operating handle 41 extending laterally from one of the side walls 11 for controlling the long plates 441 to clamp the rod 43 or not. When releasing the long plates 441 from clamping the rod 43 by operating the operating handle 41, the back portion 50 together with the rod 52 connected to the bracket 30 can be rotated about the third pin 14 to slide the fourth pin 32 and the fifth pin 31 along the second slots 17 and the fourth slots 110 respectively, thus depressing the urging element 60 and pushing the transmitting means 44 to push the second pin 24 within the first slots 16. Because the front end of the inner frame 20 is pivotally connected to the base frame 10 by the first pin 13 and the rear end of the inner frame 20 is connected to the second pin 24 and, the inner frame 20 is fixedly connected to the chair stand 22 such that when bracket 30 is rotated, only the base frame 10 can be rotated and the rear end of the base frame 10 together with the seat portion 51 are rotated about the first pin 13.

Figure 1:
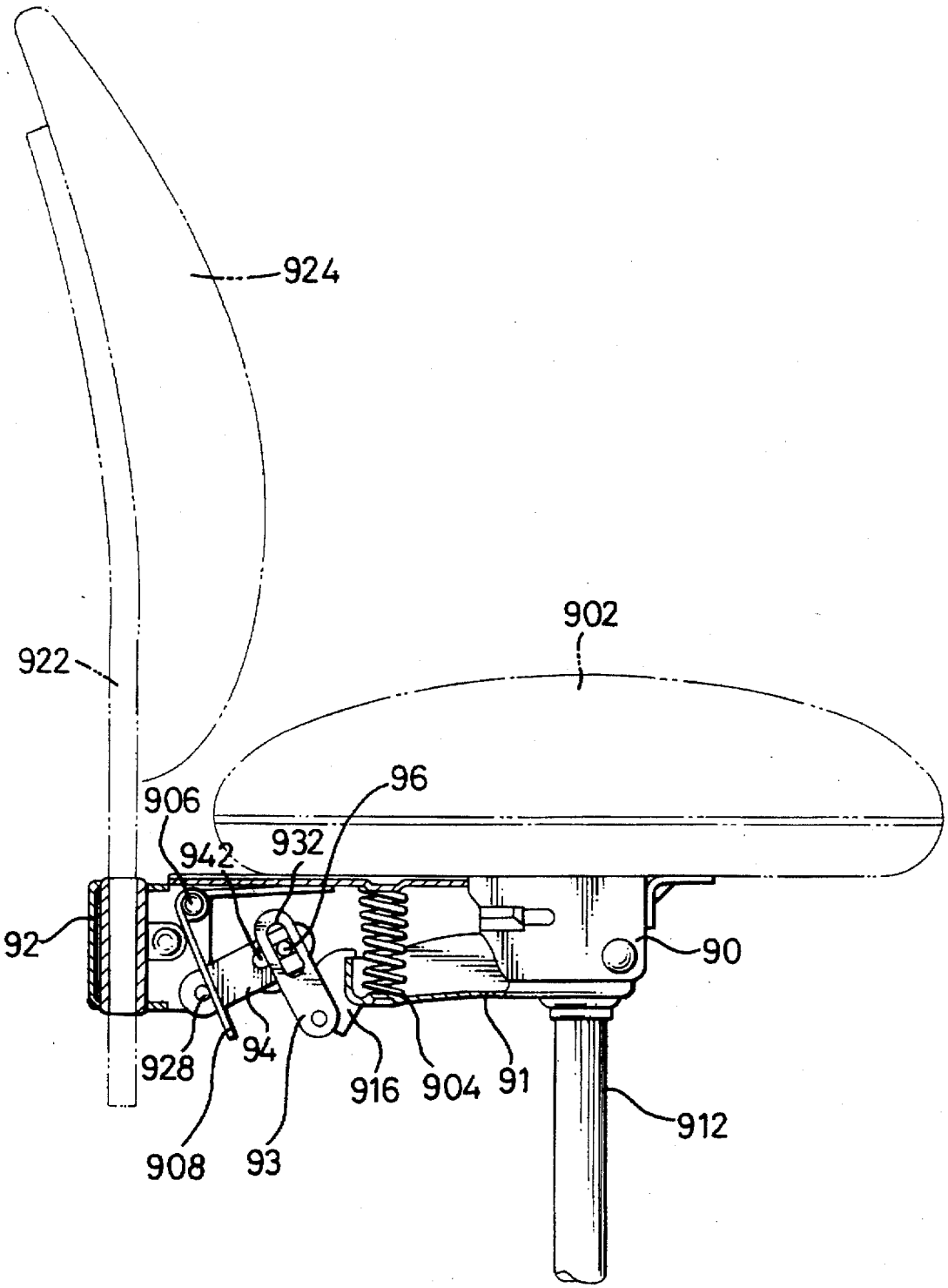
FIG.1 PRIOR ART
FIG. 1 is a side elevational view, partly in section, of a conventional adjusting device disposed in a chair.

Accordingly, the adjusting device allows a user to adjust the back portion 50 and the seat portion 51 simultaneously and the structure of the adjusting device has fewer components compared to the conventional adjusting device as shown in FIG. 1.

Although the invention has been explained in relation to its preferred embodiment, it is to be understood that many other possible modifications and variations can be made without departing from the spirit and scope of the invention as hereinafter claimed.

What is claimed is:

1. An adjusting device of a chair, comprising:

a base frame having two side walls extending from a front end thereof, a top plate connected across said two side walls and an open rear end, a first slot defined in a middle portion of each of said side walls, and a second slot defined in a rear end of each of said side walls, a first hole defined in each of said side walls and located between said first slots and said second slots, each of said side walls having a fourth slot defined inclinedly therein which is located above said second slot corresponding thereto;

an inner frame having a front end thereof pivotally received between said two side walls by a first pin and a rear end of said inner frame fixedly connected to a second pin which is slidably received within said two first slots of said base frame;

a bracket having an end board, two lateral plates respectively extending from said end board and a top portion connected between said two lateral plates, said top portion having an oblong hole defined therein, said two side walls of said base frame slidably received between said two lateral plates by a third pin extending through said two side walls and said two lateral plates, a fourth pin extending through said two second slots and fixedly connected between said two lateral plates;

a fifth pin extending through said two fourth slots and fixedly connected between said two lateral plates, an urging element having one end thereof connected to said fifth pin and the other end of said urging element connected to an under side of said top plate of said base frame, and a transmitting means connected between said second pin and said fourth pin, said transmitting means comprising a plurality of long plates, each of said long plates having a third slot defined therein with a quick release means extending therethrough which extends through said first holes, said quick release means comprising a rod extending through said third slots and an operating handle connected to said rod, said operating handle extending laterally from one of said side walls such that said long plates fixedly clamp said rod when said operating handle is pushed.

2. The adjusting device as claimed in claim 1 wherein said fifth pin has a first tube extending laterally therefrom in which said one end of said urging element is received, said under side of said top plate having a second tube extending therefrom in which said the other end of said urging element is received.

* * * * *